United States Patent [19]

Kinoshita

[11] 4,127,751

[45] Nov. 28, 1978

[54] LOUDSPEAKER WITH RIGID FOAMED BACK-CAVITY

[75] Inventor: Shouzo Kinoshita, Tokorozawa, Japan

[73] Assignee: Pioneer Electronic Corporation, Tokyo, Japan

[21] Appl. No.: 744,852

[22] Filed: Nov. 24, 1976

[30] Foreign Application Priority Data

| | | | |
|---|---|---|---|
| Nov. 27, 1975 | [JP] | Japan | 50-160758 |
| Jun. 4, 1976 | [JP] | Japan | 51-65406 |
| Jun. 4, 1976 | [JP] | Japan | 51-65407 |

[51] Int. Cl.$^2$ ..... H04R 1/28

[52] U.S. Cl. ..... 179/180; 181/146; 181/151

[58] Field of Search ..... 179/1 E, 180; 181/146, 181/151, 166

[56] References Cited

U.S. PATENT DOCUMENTS

| | | | |
|---|---|---|---|
| 3,720,285 | 3/1973 | Russell et al. | 181/151 |
| 3,944,757 | 3/1976 | Tsukamoto | 179/115.5 H |
| 3,982,607 | 9/1976 | Evans | 181/151 |

FOREIGN PATENT DOCUMENTS

| | | | |
|---|---|---|---|
| 1,458,536 | 11/1966 | France | 179/1 E |
| 2,189,970 | 1/1974 | France | 179/1 E |

*Primary Examiner*—George G. Stellar

*Attorney, Agent, or Firm*—Sughrue, Rothwell, Mion, Zinn and Macpeak

[57] ABSTRACT

The rear cavity of a tweeter speaker includes a cylindrical block four of a rigid, open celled, homogenous foamed material, such as aluminum. The rear end of the cylinder is cut to expose open cells, and is coated with an impermeable resin film, whereby the block absorbs and dampens back-pressure vibrations within the speaker cabinet from the low frequency woofer, and reduces standing and reflected waves generated by the tweeter. Alternatively, the entire block may be enclosed within a case five.

7 Claims, 14 Drawing Figures

LOUDSPEAKER WITH RIGID FOAMED BACK-CAVITY

BACKGROUND OF THE INVENTION

1. Field of the Invention

This invention relates to mid-range and high frequency audio speakers (tweeters), having back-cavities formed of a rigid, open celled, foamed material.

2. Description of the Prior Art

A tweeter is often mounted together with a low frequency speaker (woofer) in the same speaker cabinet. Such a tweeter is, to some extent, externally driven by the sound pressure vibrations generated inside the cabinet by the woofer. These high amplitude vibrations cause harmonic distortion and cross modulation distortion. In order to overcome this problem, conventional tweeters are provided with a closed cavity on the rear side to diminish the back-pressure effects caused by the woofer. Such a cavity is typically formed by pressed iron sheets, molded plastic, or paper and wood, and its strength is generally insufficient to adequately withstand the high amplitude pressures induced by the woofer. Furthermore, the cavity itself is vibrated to some degree by the woofer backpressure, and the tweeter diaphragm is thus driven by the air within the cavity, which leads to distortion.

In addition, the acoustic pressure generated inside the cavity by the tweeter itself creates standing waves and reflected waves, and the reaction of these waves with the speaker diaphragm lowers the frequency response and transient characteristics, and induces harmonic distortions. Heretofore, a sound absorbing material, such as glass wool, has been put in the hollow cavity to suppress the standing and reflected waves. Glass wool has a relatively high acoustic absorptivity at frequencies above 2,000 Hz; its acoustic absorptivity decreases sharply, however, at lower frequencies. The standing and reflected waves generated in the cavity depend on, inter alia, the dimensions of the cavity. In a typical example, where the cavity is 150 mm in diameter and 150 mm in depth, and the nominal diameter of the loudspeaker installed therein is 120 mm, these waves are generated at frequencies of approximately 800–1000 Hz. Thus, the conventional sound absorbing materials are ineffective to adequately suppress standing waves or reflected waves at these frequencies.

SUMMARY OF THE INVENTION

Accordingly, an object of this invention is to provide an audio speaker for mid-range and high frequency sounds in which all or part of the cavity behind the speaker is formed by a rigid foamed material having a high acoustic absorption characteristic, thereby prventing woofer back-pressure distortions and interference, and suppressing the generation of both standing waves and reflected waves within the cavity, whereby the frequency response characteristics of the speaker are greatly improved.

BRIEF DESCRIPTION OF THE DRAWINGS

FIG. 2 is a central sectional elevation showing a cone type loudspeaker in which the entire cavity is formed by a foamed material, FIG. 3 is a similar elevation showing a dome type loudspeaker in which the entire cavity is formed by a foamed material, FIG. 4 is a similar elevation showing a cone type loudspeaker in which only a part of the cavity is formed by a foamed material and a case is provided, and FIGS. 5 and 6 are similar elevations illustrating cone type loudspeakers in which a foamed material is employed for a part of the cavity, and in which a flanged annular body is provided.

DETAILED DESCRIPTION OF THE PREFERRED EMBODIMENTS

In the present invention, a rigid, open celled, homogenous foamed material is employed as a sound absorbent in the back-cavity of a speaker, and exhibits high acoustic absorptivity even in the wide frequency range from 500 Hz to 10,000 Hz. Such absorbency greatly suppresses both standing waves and reflected waves, which significantly improves the reproduction or performance characteristics of a loudspeaker diaphragm.

Figure 1A:
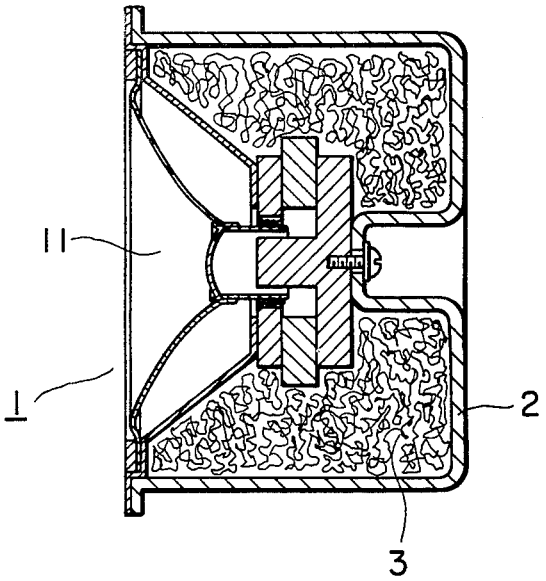
FIG. 1A PRIOR ART
FIGS. 1A and 1B show central sectional elevations of conventional cone and dome tweeters, respectively.
Figure 1B:
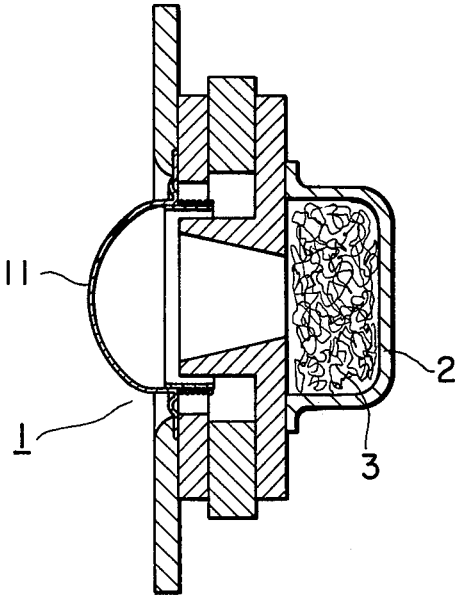
FIG. 1B PRIOR ART
Figure 9:
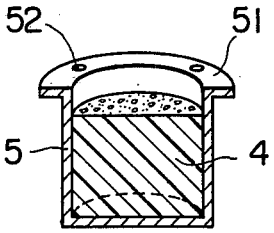
FIG. 9 shows a back-cavity using a foamed block shown in FIG. 8.

According to one aspect of the invention, a foamed material 4, as shown in FIG. 9, is enclosed in a cylindrical metal case 5 which reinforces the foamed material. Alternatively, the high rigidity of the foamed material itself may offer sufficient reinforcement. The cut rear surface of the foamed material has a plurality of minute, open cells separated by the walls of the foam. When a non-permeable film, such as a resin coating, is applied to the rear surface of the foamed material, it does not present a planar surface but instead forms an uneven surface as it flows into the open cells. This damps vibrations caused by the acoustic pressure to the rear of the speaker, and increases the strength of the foamed material itself. Thus, neither the cavity nor the foamed material is vibrated by the woofer back pressure, and the air within the cavity is also free from such back pressure vibration. In addition, since the cavity itself is at least partially formed by the foamed material, its overall dimensions are no greater than the prior art rear cavities, whereby low frequency resonance is minimized and wide band reproduction can be obtained. FIGS. 1A and 1B illustrate examples of conventional loudspeakers 1 for middle and high pitched sounds (tweeters). Their back-cavities 2 are filled with an absorbent material 3, such as glass wool.

Figure 2:
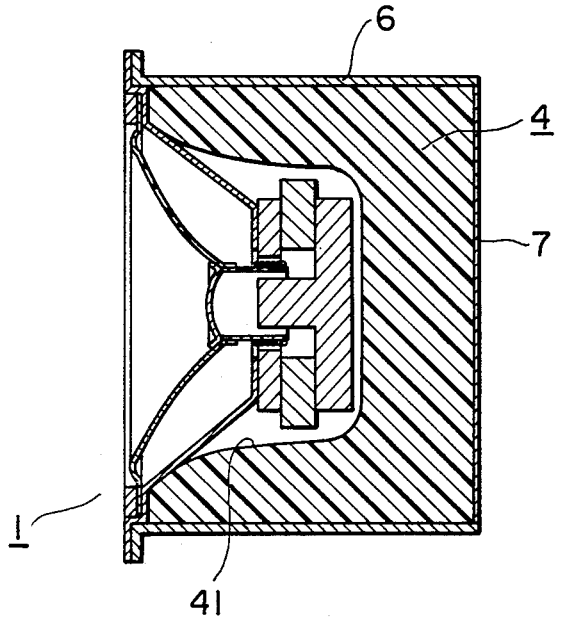
FIGS. 2 through 6 are explanatory diagrams illustrating various tweeter embodiments according to this invention. More specifically.
Figure 3:
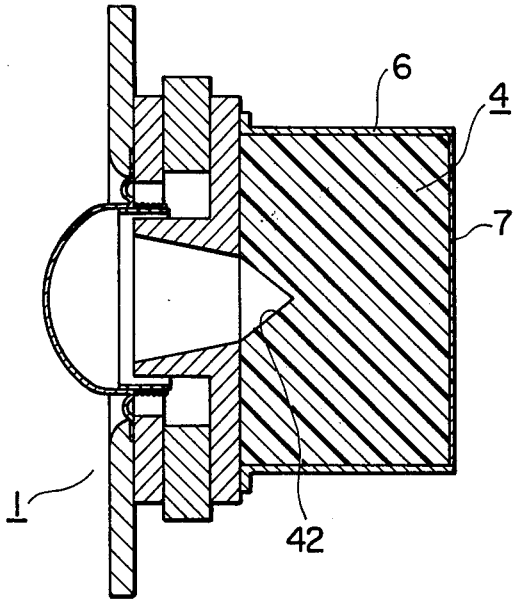

FIGS. 2 and 3 show a cone type loudspeaker and a dome type loudspeaker, respectively, according to the invention. Reference numeral 4 designates a continuous foamed material, such as foamed concrete or foamed metal (such as aluminum). The method of forming the foamed material will be described later. In FIG. 2, a recess 41 for receiving the loudspeaker body 1 is provided in the foamed structure 4. In FIG. 3, a conical indentation 42 corresponding to the air aperture of the loudspeaker body 1 is provided in the foamed structure so that the latter can be mounted over the rear side of the loudspeaker body 1. In the embodiment of FIGS. 2 and 3, the entire back-cavity is constituted by the foamed material.

Figure 4:
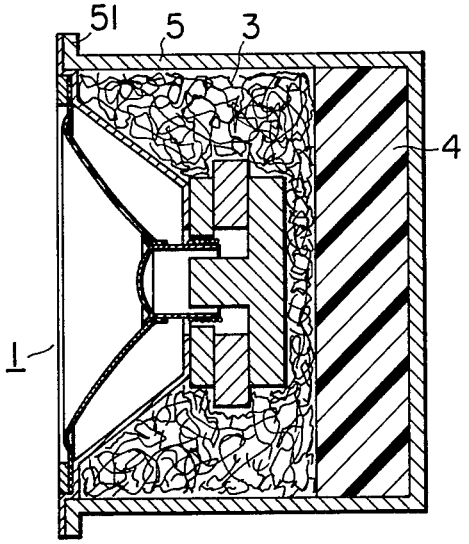
Figure 5:
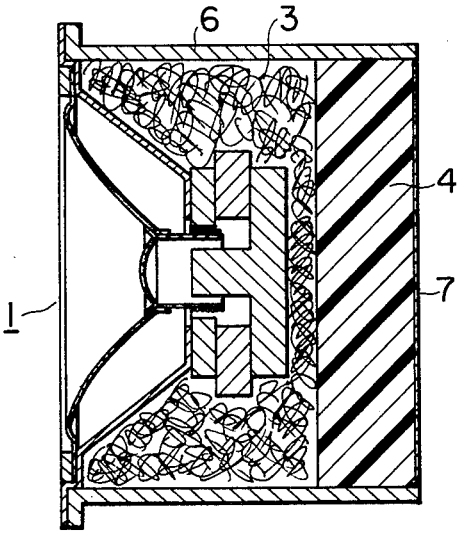
Figure 6:
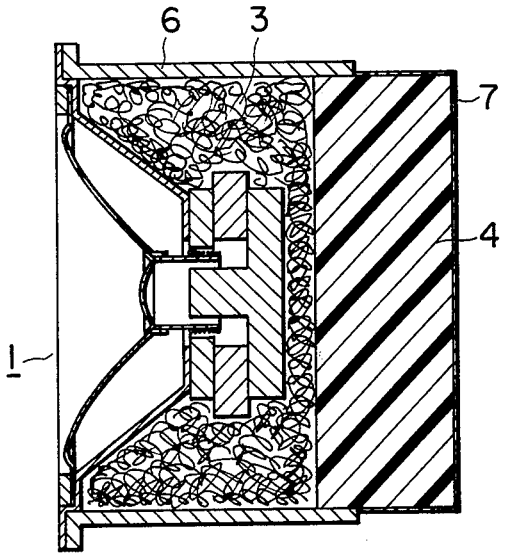
Figure 10:
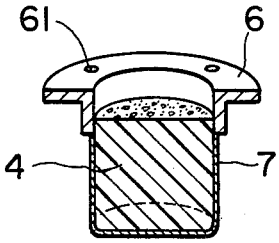
FIG. 10 shows a back-cavity employing a foamed block shown in FIG. 8 and a flange-shaped annular body.

Next, an embodiment will be described in which only a part of the back-cavity is constituted by the foamed structure. Such an embodiment can be effected by employing a case for fixing the foamed material therein (FIG. 9), or by connecting a collar or flange-shaped annular body to one end of the foamed structure (FIG. 10). FIG. 4 illustrates the former example employing a case, while FIGS. 5 and 6 illustrate the latter example employing a flange-shaped annular body.

Figure 7:
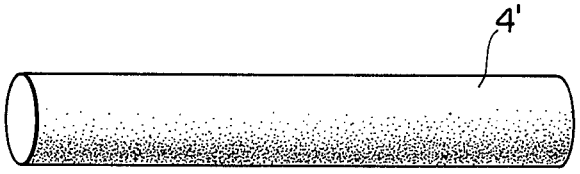
FIG. 7 is a perspective view showing a foamed pillar-shaped material to be employed as a sound absorbent.
Figure 8:
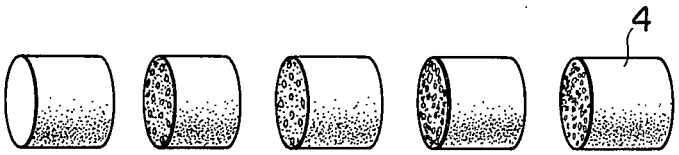
FIG. 8 is a perspective view illustrating foamed blocks obtained by cutting the pillar-shaped material perpendicular to its axis.
Figure 11:
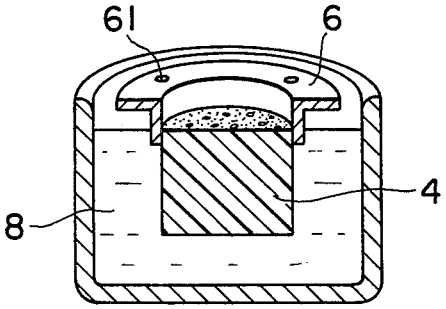
FIG. 11 is an explanatory diagram for describing a method of forming a back-cavity employing a resin solution.

The method of manufacturing the foamed structure will now be described. First, a foaming agent is added to concrete or metal, such as aluminum, in a fluid state. The fluid material is poured into a cylindrical or prism-shaped mold, and the mold is then heated, whereby bubbles are formed in the material by the foaming agent. As the material hardens small holes are formed in the bubble walls, resulting in a rigid, open celled structure containing a uniform or homogenous distribution of various sized, ruptured bubbles. The desired foamed pillar-shaped body 4' (FIG. 7) having a continuous cellular structure is formed in this manner. A skin layer is formed on the outside of the body as it sets or hardens. The pillar-shaped body is then cut perpendicular to its axis into several pieces or pillar-shaped blocks 4 each having a desired length, as shown in FIG. 8. Thus, a block 4 made of a sound absorbing foamed material is obtained. Since the cut end of the block confronts or faces the loudspeaker, no additional cutting or end face preparation is necessary. The block is mounted within and adhered to the case 5 by a soft setting adhesive applied to the skin layer, i.e. rubber cement, acrylic or vinyl acetate adhesive, etc. This increases the acoustic absorptivity of the cavity, and prevents adhesive rupture during use owing to sonic pressures and vibrations.

Where a case is employed, as shown in FIG. 4, the block is placed in the case as shown in FIG. 9 and is fixedly adhered thereto by its smooth side surface. A flange 51 is formed on the upper open end of the case 5 to facilitate mounting the case on the rear side of the loudspeaker. A baffle board may be interposed for supporting the loudspeaker. Where no case is employed, as in FIGS. 5 and 6, a flange-shaped annular body 6 for supporting the loudspeaker is provided on the upper end of the foamed structure 4 as shown in FIG. 10. Mounting holes are provided on the annular body 6, for securing the latter directly or through the baffle board to the loudspeaker. The exposed side and bottom surfaces of the foamed block 4 are covered with a nonpermeable, air-tight film 7. The film may be provided by immersing the exposed surfaces in a resin solution 8, as shown in FIG. 11, and then removing and drying the adhering resin film. Alternatively, the resin solution may be applied on the exposed surfaces of the block with a brush. A vinyl acetate emulsion, urethane resins, or the like can be employed as the resin solution.

Figure 12:
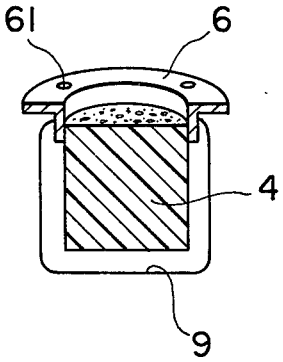
FIG. 12 is an explanatory diagram for describing a method of forming a back-cavity employing a thermal contractive resin.

In another method a bag-shaped film 9 made of a thermally contractive resin, as shown in FIG. 12, is placed over the exposed surfaces of the foamed block 4, and is contracted by heating to form the air-tight film 7. In all of these methods, it is preferable that the thickness of the air-tight film be sufficient to preclude the formation of pin holes, i.e. approximately 10 $\mu$ or thicker.

In the examples shown in FIGS. 4, 5 and 6, an ordinary sound absorbent material 3, such as glass wool, is provided between the loudspeaker 1 and the foamed structure 4. This sound absorbent material effectively prevents sound reflections in the foamed structure, and provides a dust-proofing effect for the loudspeaker.

Figure 13:
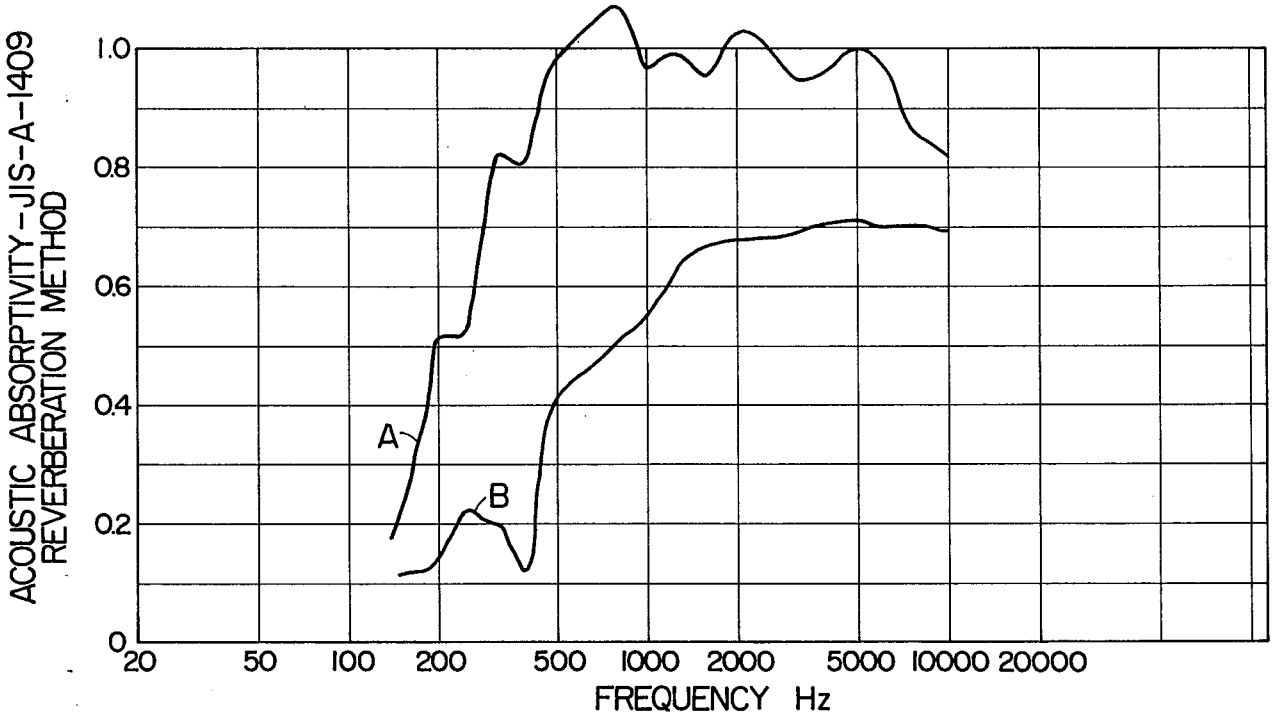
FIG. 13 is a graph showing sound absorbing characteristics according to a "reverberation method".

FIG. 13 shows acoustic absorptivity plots according to a "reverberation method" of measurement as specified in the JIS Standards, to clearly indicate the difference in sound absorbing characteristics between the back-cavity of this invention and the back-cavity employed in conventional loudspeaker systems for middle and high pitched sounds. Curve A represents the measurements made using a foamed concrete 70 mm thick and having a specific gravity of 0.38, while curve B corresponds to a conventional glass-wool sample 25 mm thick. The graphical representation shown in FIG. 13 includes some slight measurement errors, which accounts for curve A twice exceeding the theoretical absorptivity limit of one.

What is claimed is:

1. In an audio speaker assembly for mid-range and high frequency sounds adapted to be mounted in a speaker cabinet together with a low frequency speaker, and including a generally cylindrical back cavity surrounding and projecting to the rear of the speaker within the cavity, the improvement characterized by:

the back cavity having disposed therein a rigid, homogenous, open celled, foamed material block having a high acoustic absorptivity characteristic, an annular flange-shaped mounting member holding said foamed material, and a separate nonpermeable, air-tight film covering the side and back walls of said foamed block.

2. A speaker assembly as claimed in claim 1, wherein said foamed material is secured to said mounting member, which in turn is secured to said speaker cabinet.

3. A speaker assembly as claimed in claim 2, wherein said foamed material is foamed concrete.

4. A speaker assembly as claimed in claim 1 wherein said mouting member is secured to said speaker.

5. A speaker assembly as claimed in claim 1, wherein said air-tight film is selected from the group consisting of a vinyl acetate emulsion, a urethane resin, and a thermally contractive resin.

6. The speaker of claim 5 wherein said air-tight film is formed from a liquid resin applied by immersing said block such that upon drying a thickness of at least 10 microns remains on the side and back walls.

7. The speaker of claim 5 wherein said air-tight film is formed to a thickness of at least 10 microns .

* * * * *